US006681445B2

(12) United States Patent
Huang

(10) Patent No.: US 6,681,445 B2
(45) Date of Patent: Jan. 27, 2004

(54) PULLEY SET FOR DOORS AND WINDOWS

(75) Inventor: Queng Chi Huang, Kaohsiung (TW)

(73) Assignee: Chen Chang Plastics Co., Ltd., Kaohsiung (TW)

( * ) Notice: Subject to any disclaimer, the term of this patent is extended or adjusted under 35 U.S.C. 154(b) by 105 days.

(21) Appl. No.: 09/947,529

(22) Filed: Sep. 7, 2001

(65) Prior Publication Data

US 2002/0039940 A1 Apr. 4, 2002

(30) Foreign Application Priority Data

Sep. 7, 2000 (TW) ..... 89215601 U

(51) Int. Cl.[7] ..... A47H 15/00
(52) U.S. Cl. ..... 16/105
(58) Field of Search ..... 16/97, 105, 91, 16/93 R; 248/669; 403/109.5, 350, 409.1

(56) References Cited

U.S. PATENT DOCUMENTS

| | | | | | |
|---|---|---|---|---|---|
| 257,401 | A | * | 5/1882 | Somers | 16/100 |
| 343,994 | A | * | 6/1886 | Ives | 16/105 |
| 350,638 | A | * | 10/1886 | Prindle | 16/102 |
| 350,639 | A | * | 10/1886 | Prindle et al. | 16/102 |
| 426,390 | A | * | 4/1890 | Lane | 16/102 |
| 438,587 | A | * | 10/1890 | Richards | 16/102 |
| 477,739 | A | * | 6/1892 | Dahmer | 16/105 |
| 524,609 | A | * | 8/1894 | Prouty | 16/105 |
| 2,668,318 | A | * | 2/1954 | le Bon, III | 16/100 |
| 3,443,340 | A | * | 5/1969 | Helmick et al. | 49/420 |
| 3,656,203 | A | * | 4/1972 | Waflart, Jr. | 16/35 R |
| 4,262,451 | A | * | 4/1981 | Dallaire | 49/425 |
| 4,404,771 | A | * | 9/1983 | Murase et al. | 49/425 |
| 4,633,615 | A | * | 1/1987 | Moose | 49/425 |
| 5,860,189 | A | * | 1/1999 | An | 16/91 |
| 5,950,279 | A | * | 9/1999 | Chaput | 16/105 |
| 6,021,547 | A | * | 2/2000 | Stagoll | 16/105 |

* cited by examiner

*Primary Examiner*—Gary S. Hartmann
(74) *Attorney, Agent, or Firm*—Stevens, Davis, Miller & Mosher, LLP

(57) ABSTRACT

An pulley set includes a base, a seat, and an adjusting unit, wherein the base defines a hollow space with one side of the hollow space forming a vertical wall having a screw hole and the other side of the hollow space forming an inclined wall. A guiding plane parallel to the inclined wall extends from the vertical wall, and positioning slots are respectively formed in the guiding plane and the inclined wall. The seat is mounted within the hollow space of the base and has two inclined planes corresponding to the inclined wall and the guiding plane. The adjusting unit is disposed in the screw hole of the base for pushing against the seat such that adjusting the adjusting unit will cause the seat to move along the inclined wall and the guiding plane of the base.

13 Claims, 4 Drawing Sheets

PULLEY SET FOR DOORS AND WINDOWS

BACKGROUND OF INVENTION

1. Field of the Invention

The present invention generally relates to an improved pulley set for doors and windows.

2. Description of Prior Art

Referring to FIG. 1, it shows a conventional pulley set 1 for doors and windows which comprises a housing 10 and a pulley stand 12 with a pulley 11 pivotally installed thereon. The pulley stand 12 is mounted inside the housing 10 to move obliquely along the housing 10 so that the pulley 11 is supported against the window frame. This conventional pulley set is characterized in that engaged in the pulley stand 12 is a nut board 13 which threads with an adjusting screw 14 that is rotatably fixed in the housing 10 and can only rotate at its original place. Rotating the adjusting screw 14 makes the nut board 13 to move relative to the housing 10, thereby pushing the pulley stand 12 to move obliquely along the housing 10 in order to adjust the height of the pulley 11 with respect to the doors or windows. However, the adjusting screw 14 of the conventional pulley set employs a special screw with a ring slot 140 between the head of the thread portion of the adjusting screw 14, and a metal plate 15 is engaged with the ring slot 140. Accordingly, when manufacturing, the adjusting screw 14 must require a process for forming the ring slot 140, which is not economic. In additions, the nut board 13 is not firmly engaged in the housing 10 and will shake easily when in use.

FIG. 2 shows another conventional pulley set 2 of doors and windows which comprises a housing 20, a seat 21, a pulley 22 and an adjusting screw 23, wherein the middle part of he housing 20 is provided with a pulley install portion 200 and the bottom plane thereof is an inclined plane 201 with an inclined angle and another side of the pulley install portion 200 is provided with an inclined guiding wall 202 with guiding slot 203 therein. The suitable place of the side of the housing 20 has a screw hole 204 for receiving an adjusting screw 23 and a groove 205 in which a washer 24 with the screw hole is inserted. The seat 21 with the pulley 22 pivotally mounted therein has an inclined plane 210 with engaging members 211 and another inclined plane 212 for corporation with the inclined plane 201 of the housing 20. The side of seat 21 is also provided with an inserting groove 213 for receiving a washer 25 inserted therein. When the seat 21 is installed in the pulley install portion 200 of the housing 20 for cooperating with the inclined plane 201, rotating the adjusting screw 23 will adjust the height of the pulley set 2. This conventional pulley set 2 requires inserting grooves 205 and 213 in the housing 20 and the seat 21 respectively for receiving the washers 24 and 25. However, the washers 24 and 25 made of metal not only increase the cost in manufacture for application but also require electroplating process for avoid rusting. Accordingly, there exits a need for providing an improved pulley set to overcome the problems mentioned above.

The present inventor has been engaged in the development and study of the structures of doors and windows for many years and understands and is familiar with the advantages and shortcomings associated with the conventional art. In views of problems mentioned above, the present inventor proceeded the study of improvement for the above shortcomings and invents an improved pulley set for doors and windows with more practice.

SUMMARY OF INVENTION

The primary object of the invention is to provide an improved pulley set for doors and windows, which is more stable in structure with reduced manufacturing cost To achieve the above object, the pulley set in accordance with the present invention mainly comprises a base, a set, and adjusting means. The base can be engaged within or mounted on a groove at the bottom portion of doors and windows. The base forms a hollow space for receiving other elements and one side of the hollow space forms a vertical wall having a screw hole and the other side of the hollow space forms an inclined wall. A guiding plane parallel to the inclined wall extends from the vertical wall, and positioning slots are respectively formed in the guiding plane and the inclined wall. On top of the base is formed a clip piece so as to securely mount the base to the bottom of doors and windows. The seat is mounted within the hollow space of the base and both ends of the seat are respectively adjacent to the vertical wall and the inclined wall. The seat has a single or a plurality of pulley installed therein and two inclined planes and corresponding to the inclined wall and the guiding plane. Both the two inclined planes respectively have engaging bodies that can engage with the positioning slots formed in the inclined wall and the guiding plane such that the seat can move along the inclined wall and the guiding plane of the base. The adjusting means can utilize a screw or bolt disposed in the screw hole of the base. The end of the adjusting means will push against the side of the seat such that adjusting the adjusting means will cause the seat to move along the inclined wall and the guiding plane of the base.

When adjusting the height of pulley set relative to the door or window, the user merely rotates the adjusting means in the screw hole of the base. The end of the adjusting means will push against the side of the seat such that adjusting the adjusting means will cause the seat to move along the inclined wall and the guiding plane of the base with he engaging bodies sliding in positioning slots. Accordingly, the height of the pulley set with respect to the base and door or window can be raised lowered.

BRIEF DESCRIPTION OF DRAWINGS

Other objects, aspects and advantages will become apparent from the following description of embodiments with reference to the accompanying drawings in which.

DETAILED DESCRIPTION OF THE PREFERRED EMBODIMENTS

Figure 1:
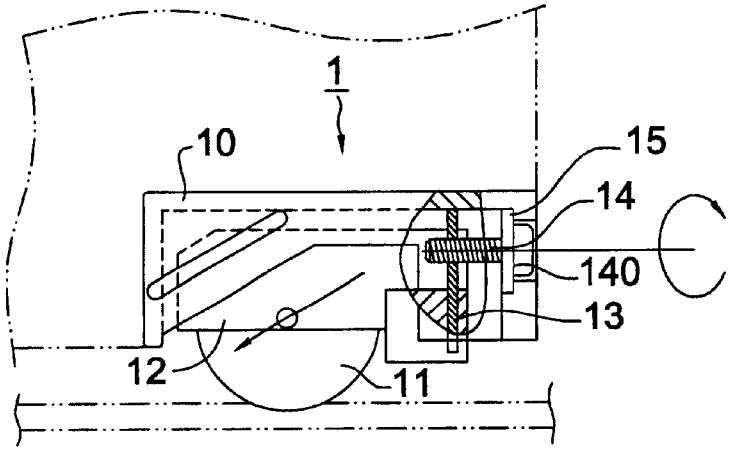
FIG. 1 (PRIOR ART)
FIG. 1 is a cross sectional view of a conventional pulley set.
Figure 2:
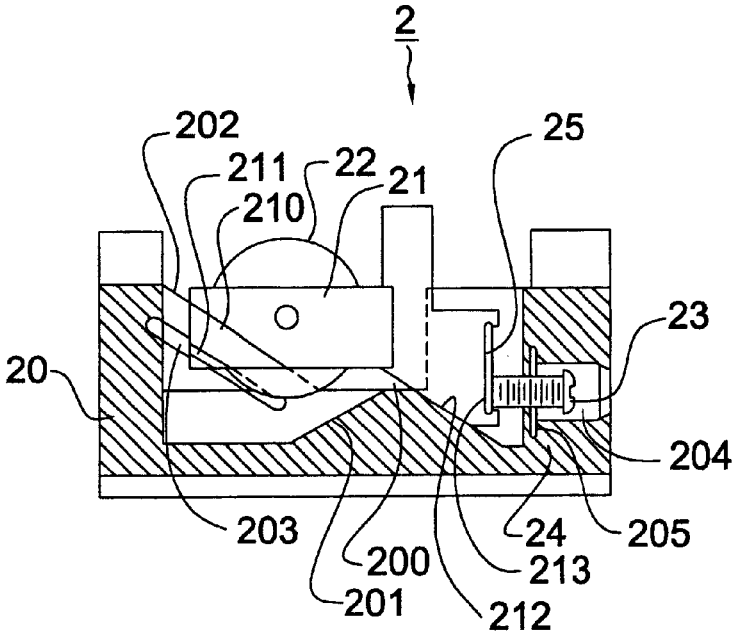
FIG. 2 (PRIOR ART)
FIG. 2 is a cross sectional view of another conventional pulley set.
Figure 3:
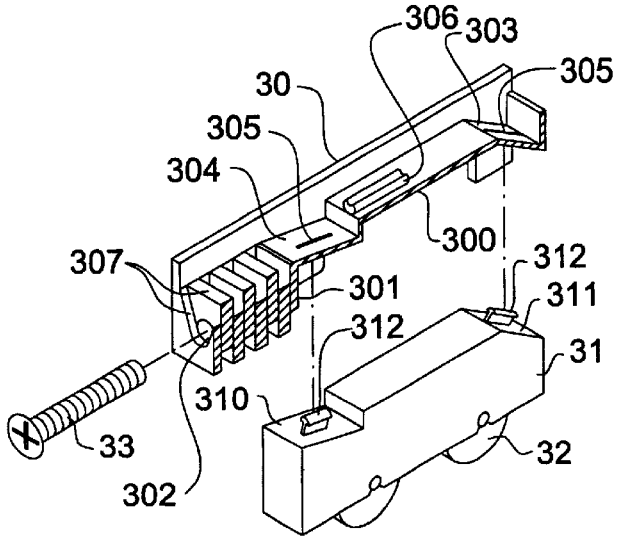
FIG. 3 is a perspective view of the pulley set in accordance with the present invention.
Figure 4:
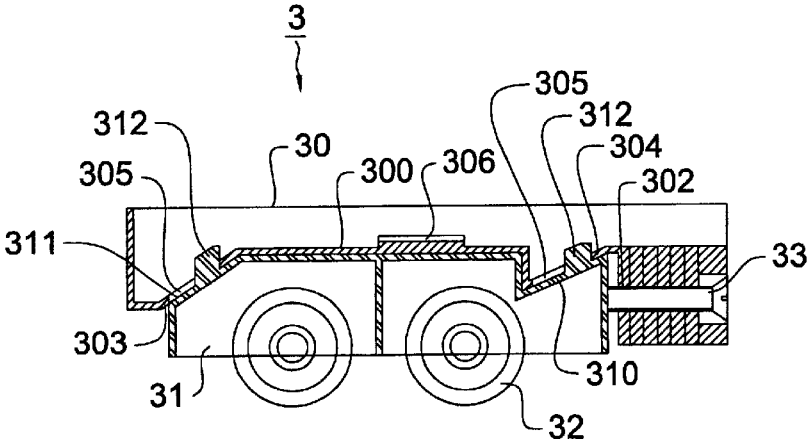
FIG. 4 is a cross sectional view of a first embodiment of the pulley set in accordance with the present invention.

Referring to FIGS. 3 and 4, they respectively show the perspective view and cross sectional view of the pulley set 3 of the first embodiment of the invention.

The pulley set 3 mainly comprises a base 30, a set 31, and adjusting means 33. The base 30 can be engaged within or mounted on a groove at the bottom portion of doors and windows. The base 30 forms a hollow space 300 for receiving other elements and one side of the hollow space 300 forms a vertical wall 301 having a screw hole 302 and the other side of the hollow space 300 forms an inclined wall 303. A guiding plane 304 parallel to the inclined wall 303 extends from the vertical wall 301, and positioning slots 305 are respectively formed in the guiding plane 304 and the inclined wall 303. On top of the base 30 is formed a clip piece 306 so as to securely mount the base 30 to the bottom of doors and windows.

A seat 31 is mounted within the hollow space 300 of the base 30 and both ends of the seat 31 are respectively adjacent to the vertical wall 301 and the inclined wall 303 of the base 30. The seat has a single or a plurality of pulley 32 installed therein (two pulleys shown in the drawing) and two inclined planes 310 and 311 corresponding to the inclined wall 303 and the guiding plane 304. Both the two inclined planes 310 and 311 respectively have engaging body 312 that can engage with the positioning slots 305 formed in the inclined wall 303 and the guiding plane 304 such that the seat 31 can move along the inclined wall 303 and the guiding plane 304 of the base 30.

The adjusting means 33 can utilize a screw or bolt disposed in the screw hole 302 of the base 30. The end of the adjusting means 33 will push against the side of the seat 31 such that adjusting the adjusting means 33 will cause the seat 31 to move along the inclined wall 303 and the guiding plane 304 of the base 30.

Several blocks of concave groove 307 may form the screw hole 302 of the above base 30, as shown in FIG. 3. The several blocks of concave groove 307 are arranged criss-cross to form the screw hole 302. This procedure can reduce the manufacturing cost and the difficulty for striping the mold.

When adjusting the height of pulley set 3 relative to the door or window, the user merely rotates the adjusting means 33 in the screw hole 302 of the base 30. The end of the adjusting means 33 will push against the side of the seat 31 such that adjusting the adjusting means 33 will cause the seat 31 to move along the inclined wall 303 and the guiding plane 304 of the base 30 with the engaging bodies 312 sliding in positioning slots 305. Accordingly, the height of the pulley set 3 with respect to the base 30 and door or window can be raised. When the height of the pulley set 3 must be lowered, the user merely rotates the adjusting means 33 in opposite direction to release the adjusting means 33 to lower the pulley set 3 with respect to the base 30 and door or window.

Figure 5:
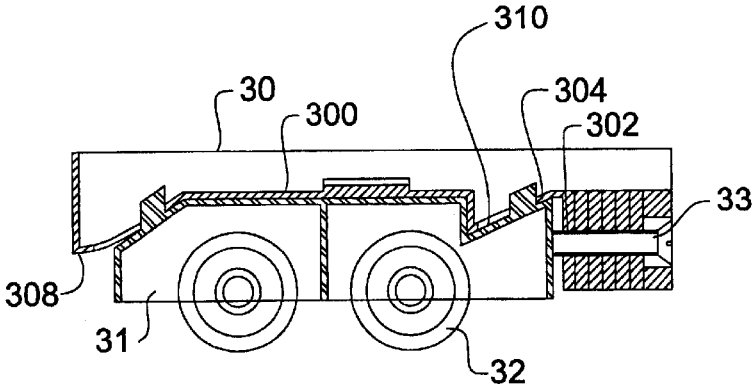
FIG. 5 is a cross sectional view of a second embodiment of the pulley set in accordance with the present invention.

Continuing to refer to FIG. 5, it is a cross sectional view of the second embodiment of the invention. The side wall of the hollow space 300 of the base 30 opposite to the screw hole 302 forms arc style and circumscribes the inclined plane 311 of the seat 31. The embodiment can also achieve the object of adjusting the height of the pulley set 3 with respect to the base 30 and door or window.

Figure 6:
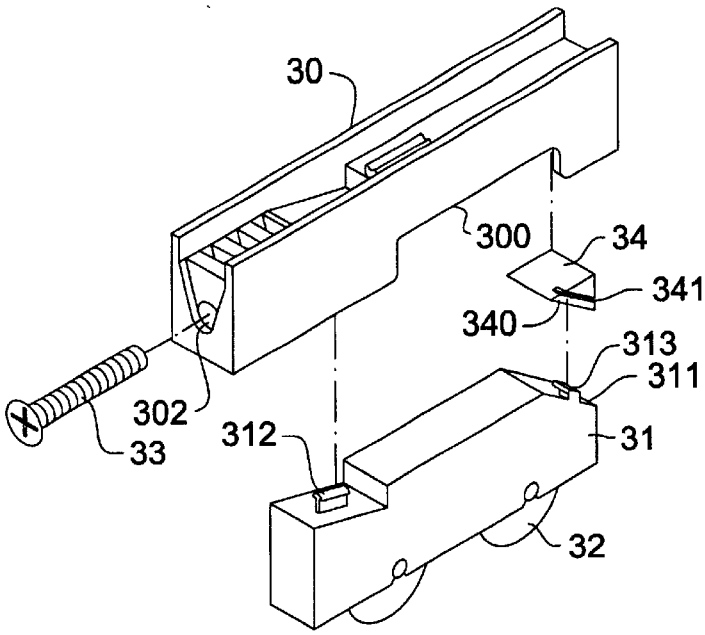
FIG. 6 is a perspective view of a third embodiment of the pulley set in accordance with the present invention.

Further referring to FIG. 6, it is a perspective view of the third embodiment of the invention. A prism body 34 is disposed at the hollow space 300 of the base 30 near the screw hole 302, and the prism body 34 forms a ramp 340 corresponding to the inclined plane 311of the seat 31 and a sliding slot 341 parallel to the ramp 34. A hook body 313 forms at the inclined plane 311 and engages with the sliding slot 341. Similar to the first embodiment, this embodiment can also achieve the object of adjusting the height of the pulley set 3 with respect to the base 30 and door or window.

Figure 7:
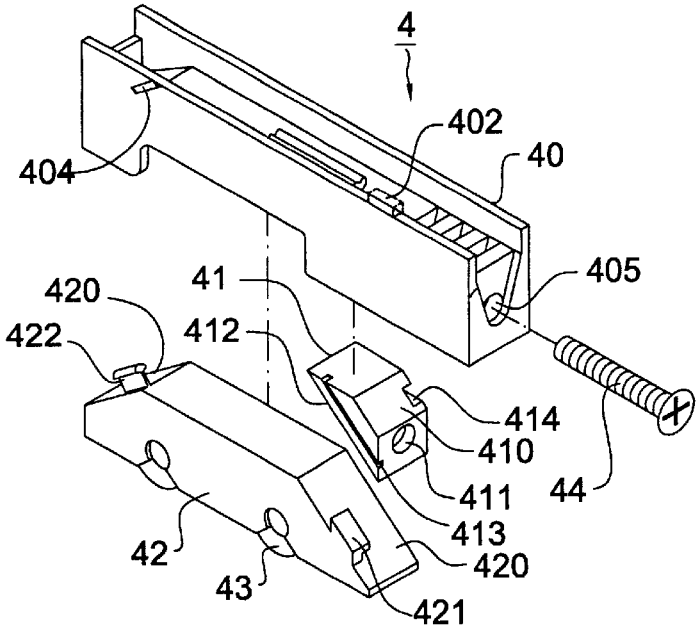
FIG. 7 is a perspective view of a fourth embodiment of the pulley set in accordance with he present invention.
Figure 8:
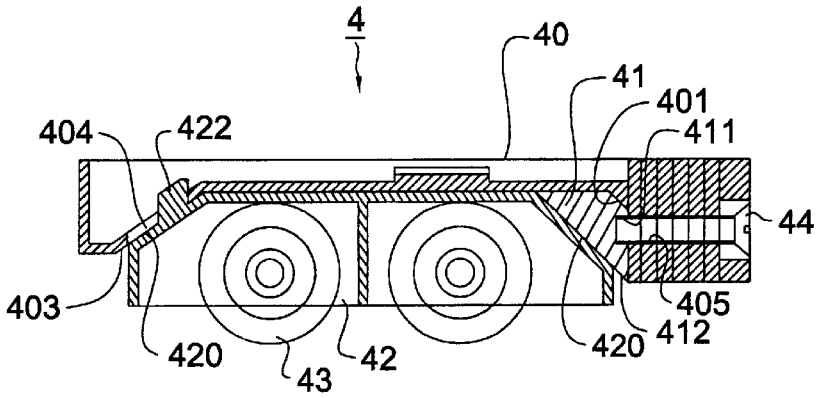
FIG. 8 is a cross sectional view of the fourth embodiment of the present invention.

Referring to FIGS. 7 and 8, they show a perspective view and a cross sectional view of the fourth embodiment of the pulley set in accordance with the present invention. The edge of the hollow space 400 of the base 40 forms an oblique wall 401 and a position-sliding track 402. A sliding body 41 moves straightly along the position sliding track 40 in the hollow space 400. As illustrated, the sliding body 41 forms a trapezoid configuration with an inclined surface 410 parallel to the corresponding oblique wall 401. The sliding body 41 has an aperture slot 411 corresponding to the screw hole 405. The other side of the sliding body 41 forms the ramp 412, a sliding slot 413 parallel to the ramp 412 and a position groove 414 which moves along the sliding track 402 of the hollow space 400. Therefore, the sliding body 41 can move securely inside the hollow space 400 of the base 40.

The seat 42 also forms the trapezoid configuration and has a single or a plurality of pulley 43 installed therein (two pulleys shown in the drawing) and the both ends thereof form inclined surfaces 420, wherein one inclined surface 420 has a hook body 421 engaging with the sliding slot 413 of the sliding body 41 and the other inclined surface 420 has an inserting body 422 engaging with the slot 404 of the slanting wall 403 of the base 40. Therefore, the seat 42 can move securely in the slanting wall 403 of the base 40 and the ramp 412 of the sliding body 41.

When adjusting the height of pulley set 4 relative to the door or window, the user merely rotates the adjusting means 44 in the screw hole 405 of the base 40. The end of the adjusting means 44 will push against the sliding body 41 and the seat 42 such that adjusting the adjusting means 44 will cause the seat 42 to move along the slanting wall 403 of the base 40 and the ramp 412 of the sliding body 41. Accordingly, the height of the pulley set 4 with respect to the base 40 and door or window can be raised. When the height of the pulley set 4 must be lowered, the user merely rotates the adjusting means 44 in opposite direction to release the adjusting means 44 to lower the pulley set 4 with respect to the base 40 and door or window.

Figure 9:
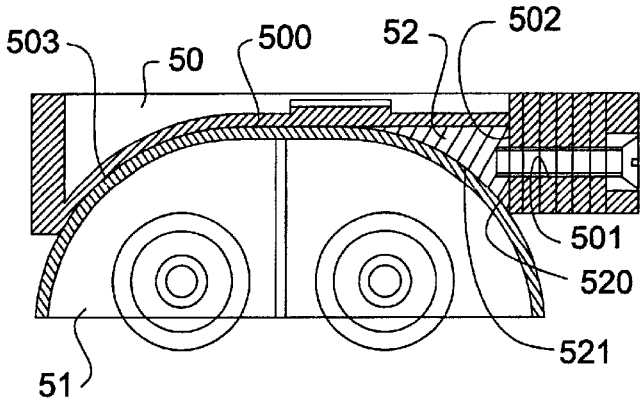
FIG. 9 is a cross sectional view of the fifth embodiment of the present invention.

Referring to FIG. 9, it is a cross sectional view of the fifth embodiment of the invention. The hollow space 500 of the base 50 forms a vertical wall 502 near the adjusting means and a concave arc wall 503 in the opposite end. The seat 51 also a corresponding arc wall 503. The sliding body 52 near the vertical wall 502 forms the flat surface 520 parallel to the vertical wall 502 and the other side forms the arc plane 521 corresponding to the seat 51. Similar to the first and second embodiments, this embodiment can also achieve the object of adjusting the height of the pulley set 5 with respect to the base 30 and door or window.

Figure 10:
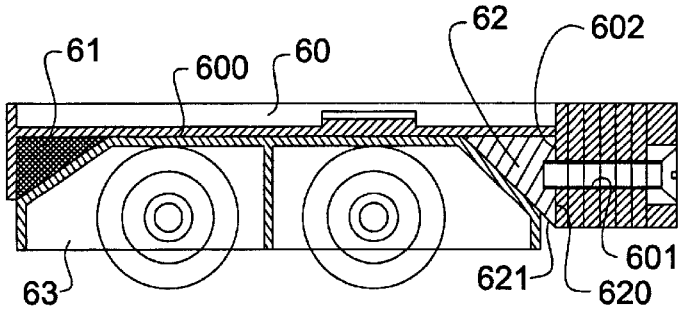
FIG. 10 is a cross sectional view of sixth embodiment of the present invention.

Referring to FIG. 10, it is a cross sectional view of sixth embodiment of the invention. The hollow space 600 of the base 60 near the screw hole 601 forms a vertical wall 602 and has a prism body 61 disposed in the hollow space 600. The sliding body 62 near the vertical wall 602 forms a flat surface 620 parallel to the vertical wall 602 and the other side forms the ramp 621. This embodiment can also achieve the object of adjusting the height of the pulley set 6 with respect to the base 60 and door or window.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claim is:

1. An improved pulley set comprising:

a base having a longitudinal axis and defining a hollow space, said base having a vertical wall defining one side of the hollow space, an inclined wall defining the other side of the hollow space and a guiding planar segment extending from the vertical wall, said inclined wall and said guiding planar segment being spaced apart along said longitudinal axis, said vertical wall having a screw hole;

a seat disposed in the hollow space of the base, the seat having two inclined surfaces for engaging respectively with the inclined wall and the guiding planar segment; and adjusting means disposed in the screw hole of the base for pushing against the seat such that adjusting the adjusting means will cause said two inclined surfaces of the seat to move along the inclined wall and the guiding planar segment of the base.

2. An improved pulley set of claim 1, wherein the two inclined surfaces have two engaging bodies extending therefrom respectively for engaging with positioning slots formed in the inclined wall and the guiding planar segment.

3. An improved pulley set of claim 1, wherein the adjusting means is a bolt.

4. An improved pulley set of claim 1, wherein the adjusting means is a screw.

5. An improved pulley set of claim 1, wherein the side wall of the hollow space opposite to the screw hole forms an inclined wall configuration.

6. An improved pulley set of claim 1, wherein the side wall of the hollow space opposite to the screw hole forms an arc configuration.

7. An improved pulley set comprising:

a base having a longitudinal axis and defining a hollow space, said base including a vertical wall defining one side of the hollow space and an inclined wall defining the other side of the hollow space, said vertical wall having a screw hole;

a sliding body disposed in the hollow space and having a trapezoid configuration with an inclined ramp, the sliding body having an aperture slot corresponding to the screw hole;

a seat disposed in the hollow space of the base, the seat having two inclined surfaces to for engaging respectively the inclined wall of the base and the inclined ramp of the sliding body, said inclined wall and said ramp being spaced apart along said longitudinal axis; and adjusting means disposed in the screw hole of the base for pushing against the sliding body at the aperture slot and the seat such that adjusting the adjusting means will cause the seat to move along the inclined wall of the base.

8. An improved pulley set of claim 7, wherein the base has a position-sliding track and the sliding body has a position groove corresponding to the position-sliding track for moving therelong.

9. An improved pulley set of claim 7, wherein one inclined surface of the seat has a hook body engaging with a sliding slot of the sliding body and the other inclined surface has an inserting body engaging with the slot of the inclined wall of the base.

10. An improved pulley set of claim 7, wherein the adjusting means is a bolt.

11. An improved pulley set of claim 7, wherein the adjusting means is a screw.

12. An improved pulley set of claim 7, wherein the side wall of the hollow space opposite to the screw hole forms an inclined wall configuration.

13. An improved pulley set of claim 7, wherein the side wall of the hollow space opposite to the screw hole forms a concave arc configuration.

* * * * *